US007197415B2

(12) United States Patent
Jamison et al.

(10) Patent No.: US 7,197,415 B2
(45) Date of Patent: Mar. 27, 2007

(54) LASER ALIGNMENT METHOD AND APPARATUS

(75) Inventors: Tommy L. Jamison, Hernando, MS (US); H. Glenn Dennis, Collierville, TN (US); Norman P. Lebel, Olive Branch, MS (US); Kevin C. Edwards, Arlington, TN (US); Kevin N. Young, Jonesboro, AR (US)

(73) Assignee: Mueller Industries, Inc., Memphis, TN (US)

( * ) Notice: Subject to any disclaimer, the term of this patent is extended or adjusted under 35 U.S.C. 154(b) by 149 days.

(21) Appl. No.: 10/602,964

(22) Filed: Jun. 24, 2003

(65) Prior Publication Data

US 2004/0267472 A1 Dec. 30, 2004

(51) Int. Cl.
*G01L 25/00* (2006.01)

(52) U.S. Cl. ..... 702/105

(58) Field of Classification Search ..... 702/105, 702/93–94, 85; 72/31.01
See application file for complete search history.

(56) References Cited

U.S. PATENT DOCUMENTS 3,728,884 A * 4/1973 Santoli ..... 72/273
3,808,859 A * 5/1974 Cameron ..... 72/31.13
4,050,281 A * 9/1977 Sibler ..... 72/265
4,084,422 A * 4/1978 Zilges et al. ..... 72/273.5
4,230,661 A * 10/1980 Asari et al. ..... 264/323
4,459,837 A * 7/1984 Hayashi et al. ..... 72/255
4,570,473 A * 2/1986 Huertgen ..... 72/255
4,631,949 A * 12/1986 Iwata et al. ..... 72/270
4,744,236 A * 5/1988 Asari et al. ..... 72/273.5
4,785,652 A * 11/1988 Stewart ..... 72/263
5,272,900 A * 12/1993 Robbins ..... 72/273
5,626,047 A * 5/1997 Bello ..... 72/273
2003/0070467 A1 * 4/2003 Bredal ..... 72/273.5

* cited by examiner

*Primary Examiner*—John Barlow
*Assistant Examiner*—Demetrius Pretlow
(74) *Attorney, Agent, or Firm*—Harness, Dickey & Pierce, P.L.C.

(57) ABSTRACT

A method for setting or calibrating a machine tool wherein the critical components the machine tool are identified as are the critical devices that are employed to affect their position and each of the possible positions to which each of the critical devices may be set. Possible combinations consisting of one possible position for each of the critical devices are evaluated to identify the possible combinations that adversely effect the output of the machine tool. A method for calibrating an extrusion press and a tooling set for obtaining data to calibrate an extrusion press are also provided.

19 Claims, 8 Drawing Sheets

LASER ALIGNMENT METHOD AND APPARATUS

FIELD OF THE INVENTION

The present invention generally relates to a method for setting or calibrating a machine tool, and more particularly to a method for determining how to re-set or re-calibrate the critical components of a machine tool so as to improve the output of the machine tool.

BACKGROUND OF THE INVENTION

Increasingly large and complex machine tools are being utilized in virtually all manufacturing disciplines to achieve gains in productivity and quality. These machine tools frequently have several critical components, each of which have two or more degrees of freedom. Each of these critical components must be accurately aligned or registered to a predetermined datum in three dimensional space for the machine tool to perform with maximum accuracy and repeatability.

Often times, however, the numerous degrees of freedom render the alignment or registration process excessively complex such that the adjustments to bring a machine tool into alignment are difficult (and sometimes impossible) for a mechanic, tradesperson or engineer (referred to hereinafter as simply "technician") to visualize or determine on the shop floor. Furthermore, we have found that attempts to adjust the alignment or registration of a machine tool's critical components given only the output of the machine tool can (and often times do) produce undesired results.

With reference to FIGS. 1 and 2 of the drawings, an exemplary extrusion press is generally indicated by reference numeral 10. The extrusion press 10 is illustrated to be a direct tube extrusion press having a stationary mandrel of the type that is commercially available from SMS Hasenclever and which is employed for producing cylindrical lengths of copper tubing. Those skilled in the art will appreciate, however, that the use of an extrusion press and the fabrication of copper tubing is merely exemplary and that the teachings of the present invention have applicability to various other machine tools and to the manufacture of various other products. Accordingly, those skilled in the art will understand that the scope of the present invention is not limited by the exemplary illustration and discussion of either an extrusion press or the manufacture of copper tubing.

In the example provided, the extrusion press 10 includes a primary frame or main structure 20, a main ram 22, a moving crosshead 24, a piercing crosshead 26, a piercer ram 28, a container 30 and a die set 32. The main structure 20 includes a front platen 40, a rear platen 42, a plurality of pre-tensioned tie rods 44, and an interior structure 46 that defines a plurality of ways 48 on which the container 30 and the moving crosshead 24 translate. The main structure 20 is constructed such that the front and rear platens 40, 42 are approximately parallel to one another, being spaced apart by an appropriate distance (e.g. 25 feet) and generally perpendicular to the longitudinal axis 50 of the extrusion press 10.

The main ram 22 is associated with the rear platen 42 and is operable for translating the moving crosshead 24 along the ways 48 between the front and rear platens 40, 42. The moving crosshead 24 includes a generally hollow body 60, a stem tooling set 62 and a plurality of support feet 64. The hollow body 60 houses the piercing crosshead 26 and the piercer ram 28. The stem tooling set 62 includes a generally hollow stem 68 that includes a pressing face 70 that is generally perpendicular to the longitudinal axis of the stem 68. The support feet 64 are coupled to the body 60 and include jack screws 72*a*, 72*b* or a similar adjustment means through which the orientation and position of the body 60 may be positioned relative to the ways 48. In practice, the massive weight of the body 60 biases the jack screws 72*a* on the lower half of the body 60 into contact with their associated ways 48, while the jack screws 72*b* on the upper half of the body 60 are adjusted so as to inhibit upward movement of the body 60 during the operation of the extrusion press 10.

As noted above, the piercing crosshead 26 and the piercer ram 28 are housed in the moving crosshead 24. The piercing crosshead 26 includes a mandrel support 76, a mandrel 78 and optionally, a plurality of feet (not shown). The mandrel support 76 is disposed within a cavity in the body 60 of the moving crosshead 24 and is movable via the piercer ram 28 between an extended position and a retracted position. The mandrel 78 is coupled to the mandrel support 76 and extends forwardly therefrom through the generally hollow center of the stem 68.

The container 30 is movable along the ways 48 between a retracted position, which is rearward of the die set 32, and an extended position, which is abutted against the die set 32. The container 30 includes a hollow sleeve 80 that is configured to receive therein a billet 82 of a suitable material, such as copper.

The die set 32 conventionally includes a pressure plate, a backer and a die 32*a*. The die 32*a* is loosely coupled to the front platen 40 to permit the die 32*a* to move in two orthogonal directions in a plane that is generally perpendicular to the front platen 40. The die 32*a* includes a tapered trailing edge (not specifically shown) that matingly engages a correspondingly shaped leading edge (not specifically shown) that is formed into the sleeve 80 of the container 30. This degree of freedom, in theory, facilitates precise alignment of the die 32*a* to the container 30 at the beginning of an extrusion cycle.

As those skilled in the art will appreciate, the output of the extrusion press 10 (i.e., the accuracy and repeatability of the tubing produced by the extrusion press 10) is a function of the alignment of the various critical components to one another. For example, if the axis of the mandrel 78 were to be shifted relative to the axis of the stem 68 (i.e., generally parallel but not coincident), the tubing produced by the extrusion press 10 may be uniformly eccentric. In more complicated scenarios where the axis of one or more the critical components are shifted out of position and/or skewed relative to another of the critical components, the product produced by the extrusion press 10 may exhibit a varying degree of non-uniformity (e.g., a varying degree of eccentricity) or in extreme cases, exhibit defects such as ruptures or breaks.

From the foregoing, those of ordinary skill in the art will appreciate the need and desirability of aligning or registering the critical components of a machine tool. In the past, the known methodologies focused on the alignment of each of a machine tool's components to a predetermined fixed datum, such as the longitudinal axis of the machine tool. With regard to the extrusion press 10, the methodology included a two-part measurement step wherein the height of each of the machine tool's components was gauged and thereafter the distance between a datum and a face of several of the machine tool's components was employed to determine the amount by which the component was offset in a lateral direction from the longitudinal axis of the extrusion press 10. In the latter part of the measurement step, the datum comprised a wire that was stretched between the front and rear platens 40, 42 by the technician conducting the measurement.

The theory behind such methodologies is logical enough—place every component into its "design" position and the machine tool will operate in its intended manner. Unfortunately, such processes are typically very time consuming and as we have found, at times costly and complicated.

With respect to the extrusion press 10, we have found that the measurements taken for the known calibration processes often require upwards of eight hours to perform and that the results obtained in this step are generally less accurate and repeatable than is desired {for example, we estimate that the accuracy of the measurements of the distance between the datum and the faces of the machine tool's components to be within about 1 mm (0.039 inch), while the repeatability of such measurements are estimated to be within about 0.5 mm (0.019 inch)}.

The corrective action to position the various components of the extrusion press 10 into their "design" position can be extremely complicated due to the number of components that are involved, the interactions between these components, and the several degrees of freedom of each of these components. The variance between the actual position of a component and its "design" position is sometimes the result of wear, which in some situations, cannot be "adjusted" or otherwise compensated for without costly rebuilding of the extrusion press 10.

In view of the aforementioned issues, there remains a need in the art for a methodology that permits a technician to quickly and accurately determine the condition of the machine tool through the evaluation of the alignment of the various critical components of the machine tool. Further, there remains a need in the art for determining the critical components of a machine tool and for quickly and accurately aligning the critical components of a machine tool.

SUMMARY OF THE INVENTION

In one preferred form, the present invention provides a method for calibrating a machine tool. The method includes: identifying a plurality of critical components (CC); identifying each critical device (CD) that is employed to affect a position of an associated critical component (CC); identifying a plurality of possible positions ($PP_{CD}$) for each critical device (CD); identifying a plurality of possible combinations (PC), each possible combination (PC) including one of the possible positions ($PP_{CD}$) for each of the critical devices (CD); and evaluating each of the possible combinations (PC) to identify which of said possible combinations ($PC_A$) adversely effect the output of the machine tool.

In another preferred form, the present invention provides a method for calibrating an extrusion press that has a container and a moving crosshead that includes a stem. The method includes aligning an axis of the container directly to an axis of the stem.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

FIG. 7 is a schematic plan view of the extrusion press of FIG. 1 illustrating a step in the methodology of the present invention wherein a lateral offset of various critical components is determined relative to the longitudinal axis of the extrusion press;

FIG. 8 is a schematic side elevation view of a portion of the extrusion press of FIG. 1, illustrating a step in the methodology of the present invention wherein relative positions of the axis of a critical component is established relative to a position of the axes of another critical component;

DETAILED DESCRIPTION OF THE PREFERRED EMBODIMENTS

In contrast to the known calibration methodologies, the approach that we have developed is somewhat more analytical in nature and requires a thorough understanding of the machine tool prior to the implementation of an action to affect the output of the machine tool. This understanding of the machine tool may be thought of as including three steps: 1) geometry; 2) measurement; and 3) experimentation.

The geometry step essentially requires that one understand which of the machine tool's components are critical to its operation, how the position (i.e., the location and/or orientation as appropriate) of each of these critical components may be altered, and how the various critical components may interact with one another to effect the output of the machine tool. Critical components are generally those components that can be selectively positioned to effect the output of the machine tool, but could also include, for example, those components that can be selectively positioned to effect the useful life of the machine tool.

A critical component generally includes one or more critical devices, such as a jack screws, shims, etc., that may be employed to affect the position of the critical component. Stated another way, each critical device permits its associated critical component to be positioned to one of a plurality of possible positions ($PP_{CD}$).

Since the position of each of the critical components may be independent of the position of other critical components, the methodology of the present invention identifies possible combinations (PC), wherein each possible combination (PC) includes one of the possible positions ($PP_{CD}$) of each critical device (CD). Thereafter, each of the possible combinations (PC) is evaluated to identify those possible combinations ($PC_A$) that adversely effect the output of the machine tool. Preferably, these possible combinations ($PC_A$) are evaluated to determine which of the critical components cause the adverse effect on the output of the machine tool so that the possible combination ($PC_A$) may be employed to identify strategic positions ($SP_{CD}$) of those corresponding critical devices (CCD) that are identified as causing the adverse effect.

Figure 1:
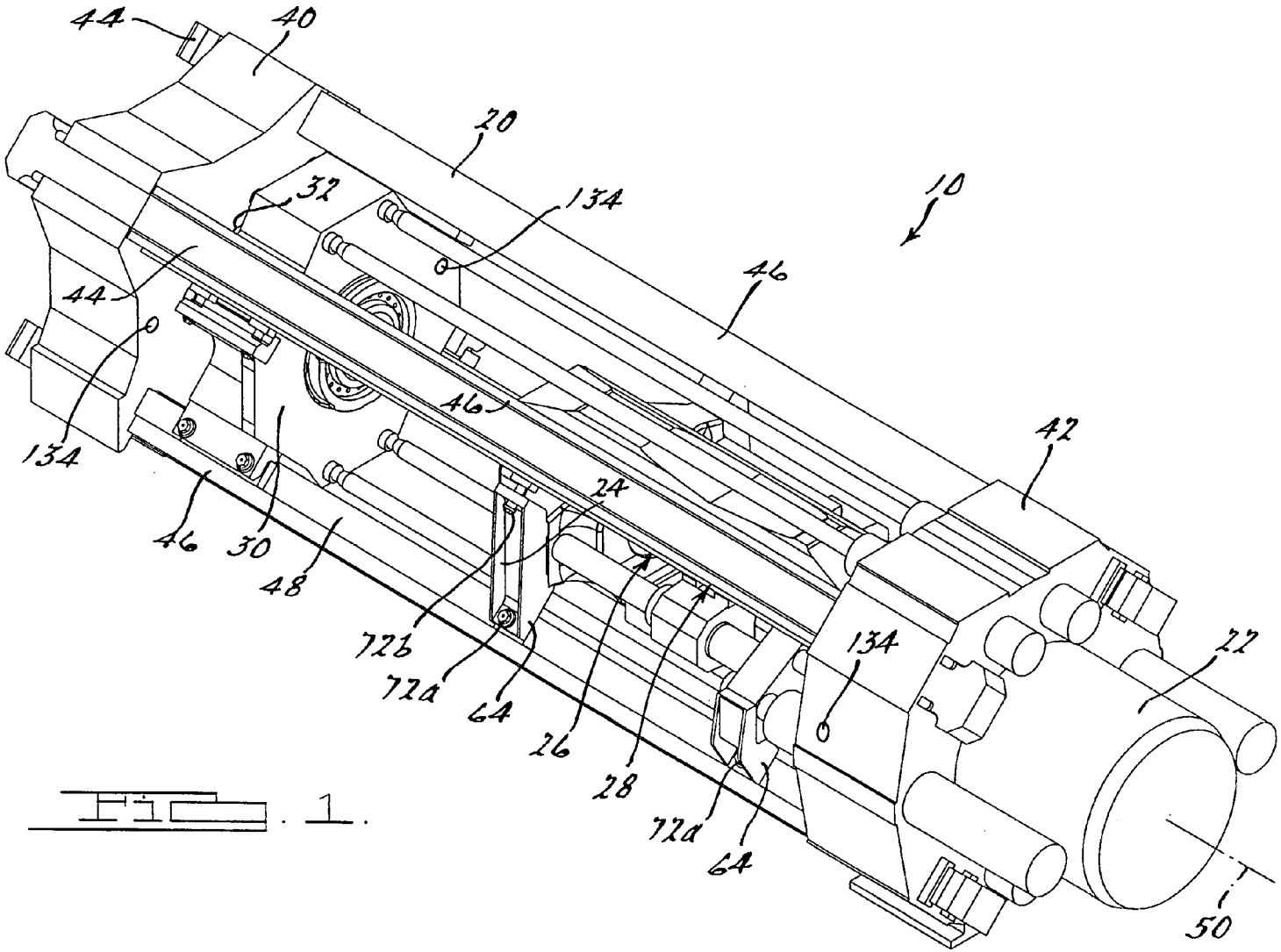
FIG. 1 is a perspective view of an exemplary extrusion press which is employed to illustrate the method and tooling of the present invention.
Figure 2:
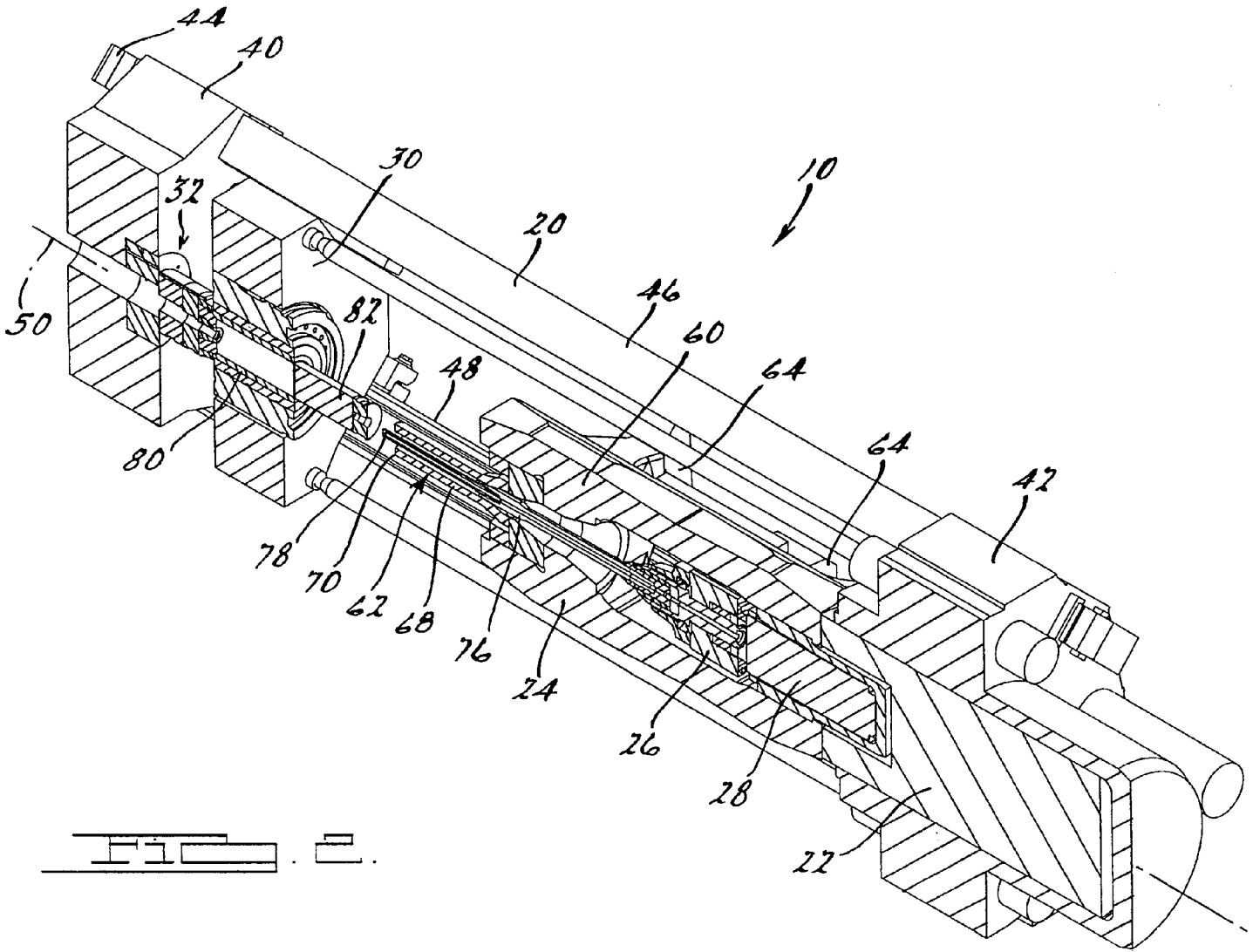
FIG. 2 is a sectional view of the extrusion press of FIG. 1 taken through its longitudinal axis.
Figure 2:
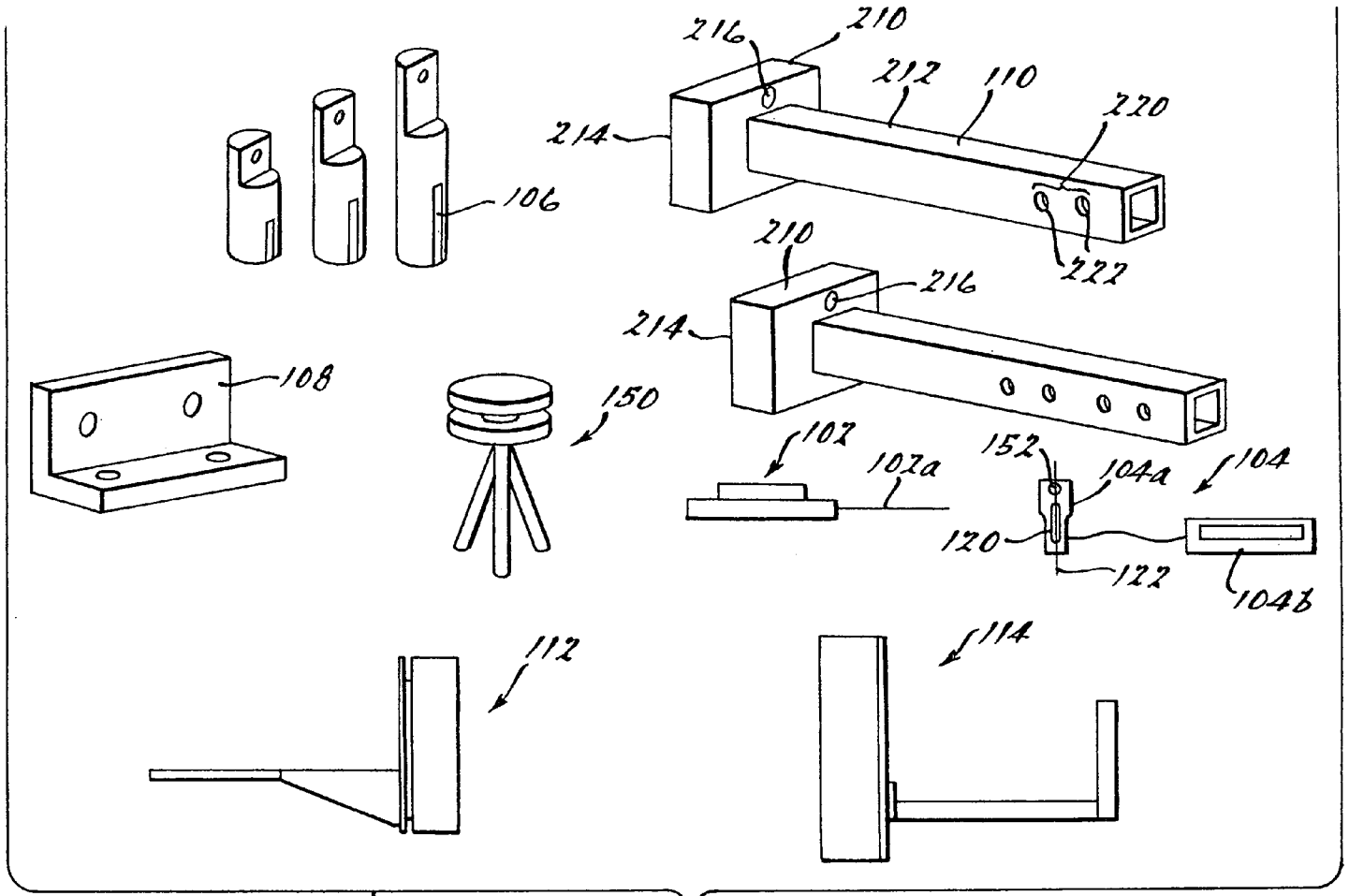

Taking the extrusion press 10 of FIGS. 1 and 2 as an example, it's ideal output is a copper tube whose inside diameter is concentric with its outside diameter. As those of even basic skill in the art will appreciate, a variation in concentricity results in the non-uniformity of the thickness of the wall of the copper tube. Since every point in the wall of the copper tube must exceed a minimum thickness, additional material is employed to account for the variations in concentricity (i.e., the thickness of the wall is increased at all points so that variations in concentricity will not cause the wall thickness to be less than the minimum thickness at any point). This "additional material" is relatively expensive yet adds no value to the copper tube. With that in mind, the container 30 and the stem 68 are critical components, since their respective positions (i.e., their locations and/or orientations) effect the output of the extrusion press 10.

In the particular example provided, the die 32*a* is not considered to be a critical component because it cannot be independently moved to effect the output of the extrusion press 10. In this regard, the die 32*a* is "free floating" (i.e., movable) such that the container 30 centers the die upon the axis of the container 30, as well as forces the die 32*a* against the front platen 40.

With the critical components of the extrusion press 10 having been identified, we next identify their critical devices (i.e., the means by which the position of each of the critical components may be moved or otherwise affected). In the example provided, each of the container 30 and the moving crosshead 24 include one or more sets of upper and lower jack screws 72*a*, 72*b* that may be employed to control the respective positions of the container 30 and the stem 68.

We employed a Yates algorithm to simplify the analysis of the extrusion press (i.e., the identification of the possible combinations, the evaluation of each possible combination and the identification of the possible combinations that adversely effect the output of the extrusion press 10). In this regard, we considered each set of upper and lower jack screws 72 to be movable to a nominal position, a high position, which elevated the associated critical component from the nominal position by a predetermined distance, such as 3 mm, that was known to adversely effect the output of the extrusion press 10, and a low position, which lowered the associated critical component from the nominal position by a predetermined distance, such as 3 mm, that was known to adversely effect the output of the extrusion press 10. Since the container 30 and the moving crosshead each employ four sets of jack screws 72, the Yates algorithm identified $3^8$ or 6,561 possible combinations (three different positions for each set of jack screws, with eight total sets of jack screws being considered).

As those skilled in the art will appreciate, various techniques may be employed to evaluate each of these combinations to determine whether they adversely effect the output of the extrusion press 10. In evaluating these combinations, we initially "factored out" any of those combinations that were known to be not physically possible (e.g., a possible combination wherein three of the four sets of jack screws 72 on the moving crosshead 24 is positioned in a nominal position and the remaining set of jack screws 72 is positioned in a high or low position), or to not adversely effect the extrusion press 10 (e.g., the possible combination wherein each set of the jack screws 72 is positioned in a nominal position), and then employed a modeling technique, such as three-dimensional solids modeling, to determine the effect that each of the remaining combinations had on the output of the extrusion press 10. The results of the solids modeling analysis were employed to identify 14 possible combinations that adversely effected the output of the extrusion press 10.

The measurement step essentially requires one to accurately determine the position of the critical components. This information may be employed to determine whether any of the critical components have been positioned into one of the possible combinations ($PC_A$) that adversely effect the output of the machine tool, as well as whether one of the corresponding critical devices (CCD) have been positioned in a strategic position ($SP_{CD}$).

Figure 3:
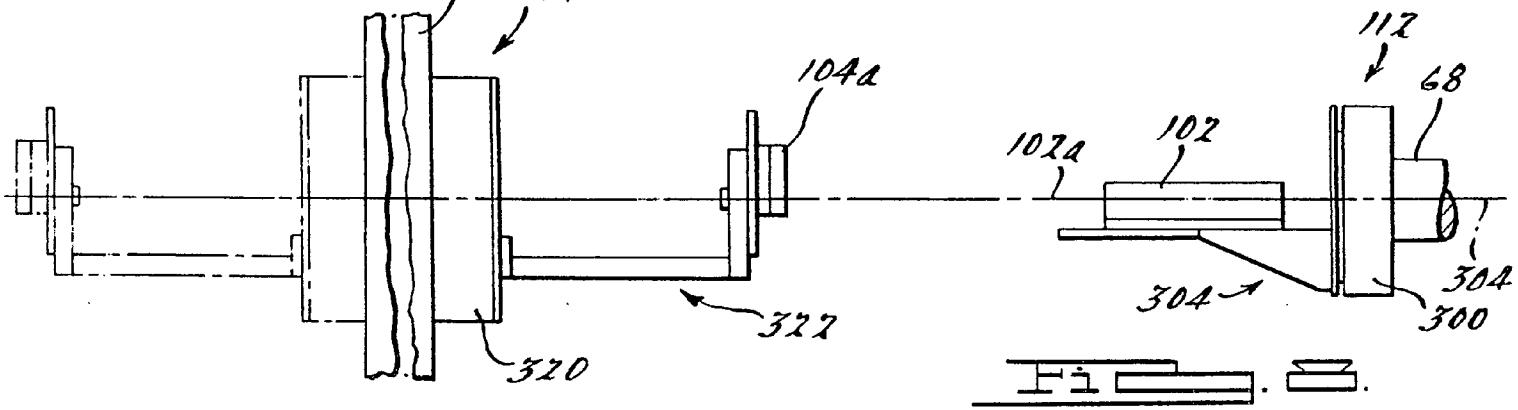
FIG. 3 is a perspective view of a tooling set constructed in accordance with the teachings of the present invention.

As noted above, we have found the accuracy of the known calibration methodologies for the extrusion press 10 to be relatively poor. Furthermore, these prior methodologies appear to have been based on assumptions that did always not hold true in practice and as such, they did not collect sufficient information to permit one to fully determine the position of one or more of the components (e.g., the container 30) of the extrusion press 10. In view of these drawbacks, we developed the tooling set 100 that is illustrated in FIG. 3. The tooling set 100 is illustrated as including a laser transmitter 102, a laser receiver 104, one or more elevation pins 106, a transmitter mount 108, at least one receiver mount 110, a first chuck 112 and a second chuck 114.

The laser transmitter 102 is an N2 or N3 type laser such as a Microgage Laser Transmitter with Precision Leveling Module that is commercially available from Pinpoint Laser Systems, Inc. of Newburyport, Mass. The laser transmitter 102 conventionally produces a laser beam 102*a* that is configured to identify a reference plane that is employed in the collection of data on the machine tool.

In the example provided, the laser receiver 104 includes both a digital laser receiver 104*a* and a data display 104*b*, such as a Microgage Remote Receiver and a Microgage Data Display which are commercially available from Pinpoint Laser Systems, Inc. of Newburyport, Mass. The digital laser receiver 104*a* includes a target portion 120 that is aligned along an axis 122 of the digital laser receiver 104*a*. When struck by the laser beam 102*a*, the target portion 120 is configured to sense the location of the laser beam 102*a* along the axis 122 of the digital laser receiver 104*a*, thereby permitting the laser receiver 104 to determine the distance between the laser beam 102*a* and a predetermined (and selectable) reference point on the axis 122 of the digital laser receiver 104*a*. The data display 104*b* is employed to display the distance measurement for electronic or manual recordation.

Figure 5:
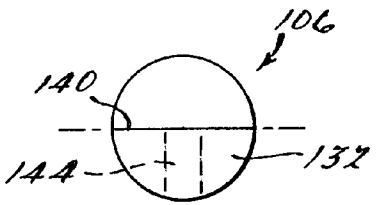
FIG. 5 is an end view of the elevation pin of FIG. 4.
Figure 4:
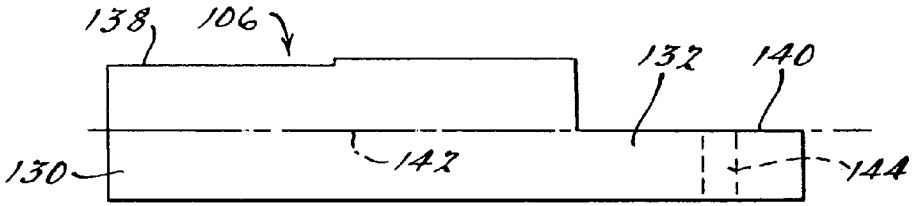
FIG. 4 is a side view of a portion of the tooling set of FIG. 3, illustrating the construction of an elevation pin in greater detail.

As the elevation pins 106 are similar to one another and differ only in their overall length, the discussion of one elevation pin will suffice for all. With additional reference to FIGS. 4 and 5, the elevation pin 106, which is formed from a suitable material, such as hardened 4140 steel, is illustrated to include an insertion portion 130 and a stepped portion 132. The insertion portion 130, which is generally cylindrical in shape, is ground or otherwise machined to a precise diameter that closely matches the diameter of the several elevation holes 134 (FIG. 1) that are formed in the container 30 and the left and right sides of the front and rear platens 40, 42 and the moving crosshead 24. Briefly, the elevation holes 134 are machined by the manufacturer of the extrusion press 10 into the various critical components. Each the elevation hole 134 is positioned at a predetermined location relative to the longitudinal axis of the extrusion press 10. The elevation holes 134 permit a technician to gauge the height of these components relative to one another and as such, the insertion portion 130 of the elevation pin 106 is sized to closely match the size of the elevation holes 134 so as to facilitate accurate measurements of the elevation of the various components.

In the particular example provided, a flat 138 is formed on the insertion portion 130 so that the insertion portion 130 does not make contact around its entire perimeter with the elevation hole 134 into which it is to be inserted. Construction of the insertion portion 130 in this manner renders the insertion portion 130 easier to locate and insert to the elevation hole 134 and also provides an escape route through which air in the elevation hole 134 is permitted to escape as the insertion portion 130 is inserted to the elevation hole 134.

The stepped portion 132 is illustrated to include a generally flat mounting surface 140 that is generally parallel and preferably coincident with the longitudinal axis 142 of the elevation pin 106. A locating aperture 144 is formed through the stepped portion 132 in a direction that is generally perpendicular to the mounting surface 140. The locating aperture 144 is sized to receive a locating pin (not specifically shown) that is removably mounted to the digital laser receiver 104*a*. The mounting surface 140 and the locating aperture 144 cooperate to align the digital laser receiver 104*a* in a manner that spaces the digital laser receiver 104*a* perpendicularly away from the longitudinal axis 142 of the elevation pin 106 by a predetermined distance.

Figure 6:
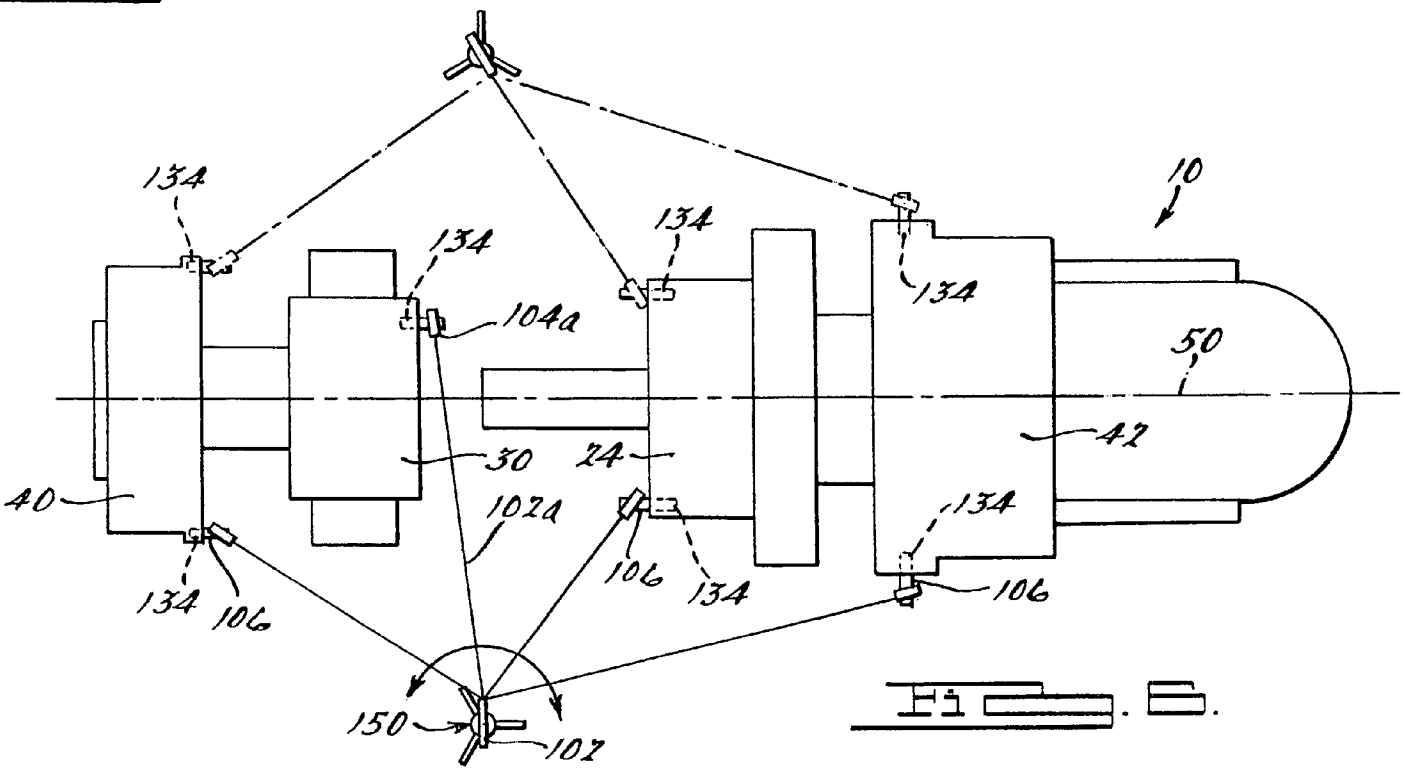
FIG. 6 is a schematic plan view of the elevation press of FIG. 1 illustrating a step in the methodology of the present invention wherein the elevation of various critical components is determined relative to the longitudinal axis of the extrusion press.
Figure 2:
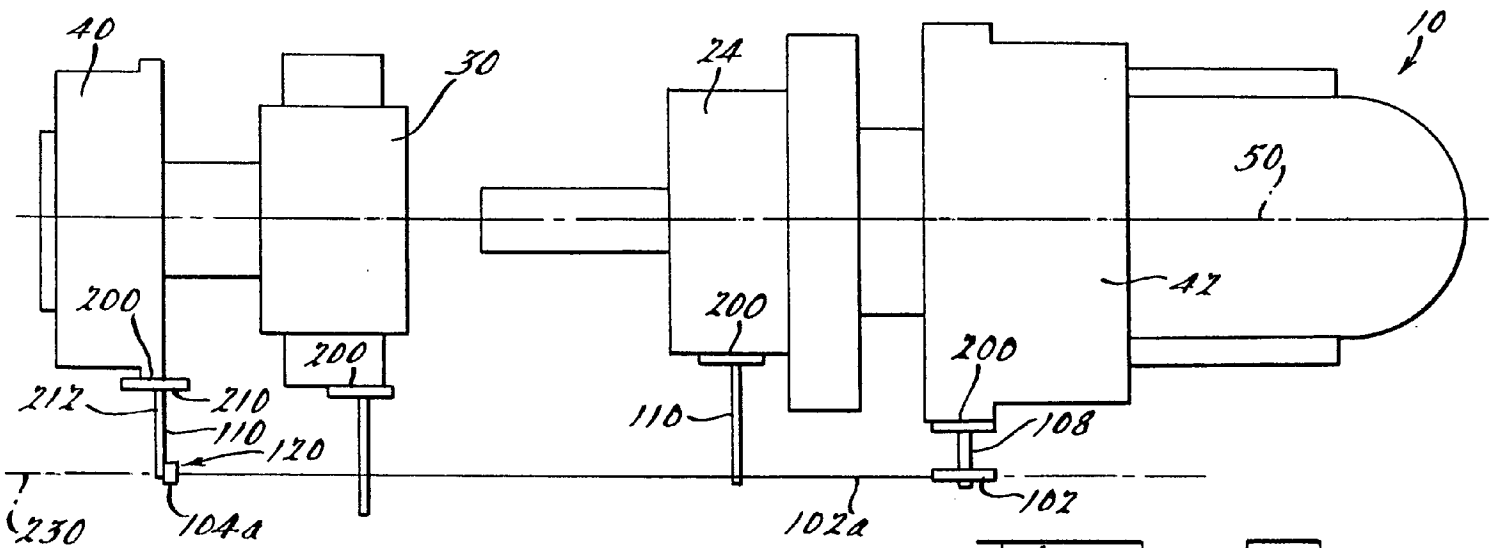

In operation, the laser transmitter 102 is mounted to a tripod 150 (e.g., a Precision Leveling Tripod that is commercially available from Pinpoint Laser Systems, Inc. of Newburyport, Mass.) that is positioned on a first lateral side of the extrusion press 10 as illustrated in FIG. 6. The laser transmitter 102 is leveled so that the beam 102*a* produced by the laser transmitter 102 is contained in a generally horizontal plane. An appropriate one of the elevation pins 106 is mounted into the elevation hole 134 of a desired component of the extrusion press 10, such as the rear platen 42, and the digital laser receiver 104*a* is mounted to the selected elevation pin 106 (via the locating pin). The laser transmitter 102 is rotated on the tripod 150 and the digital laser receiver 104*a* is rotated about the locating pin so that the laser beam 102*a* contacts the target portion 120 (FIG. 3) and the axis 122 (FIG. 3) of the target portion 120 is generally perpendicular to the laser beam 102*a*. We have found that a commercially available bubble level (not shown) may be employed to aid in and expedite the orienting of the elevation pin 106 (i.e., the bubble level permits the technician to rotate the elevation pin 106 such that the flat mounting surface 140 is roughly parallel to the laser beam 102*a*). In the particular example provided, the digital laser receiver 104*a* includes an indicator 152 (FIG. 3) that identifies those situations when insufficient light is striking the target portion 120 (FIG. 3) to thereby alert the user that the digital laser receiver 104*a* should be pivoted about one or both of the elevation hole 134 and the locating aperture 144. Once the target portion 120 and the laser beam 102*a* have been aligned (i.e., the indicator 152 (FIG. 3) is illuminated with a green light in the particular example provided), the laser receiver 104 is employed to collect height data for a particular location (i.e., for a particular elevation hole 134).

In the example provided, elevation holes 134 are provided for each of the front and rear platens 40, 42, the moving crosshead 24 and the container 30, which therefore permit the technician to collect height data at each of these points. Thereafter, the tripod 150 is relocated to the second side (opposite to the first side) of the extrusion press 10 and the process is repeated. Importantly, only the elevation hole 134 in the container 30 is re-used in this latter step. Stated another way, each of the front and rear platens 40, 42 and the moving crosshead 24 include two sets of elevation holes 134, with each elevation hole 134 being employed to collect height data on an associated side of the extrusion press 10. The container 30, however, includes a single elevation hole 134 that is employed to associate the height data from the first side of the extrusion press 10 with the height data from the second side of the extrusion press 10. More specifically, the difference between the height data measurements at the container 30 for the first and second sides of the extrusion press 10 is employed as an offset to correct the remaining height data measurements, and thereby compensate for variance in the height of the laser beam 102*a*, that result from relocating the tripod 150.

The height data for the front and rear platens 40, 42 permits the technician or a computer program to establish the location of the longitudinal axis 50 (in a vertical plane) of the extrusion press 10. The remaining height data, which is optional, may be employed by the technician or a computer program to determine a vertical offset between the longitudinal axis of various remaining critical components and the longitudinal axis 50 of the extrusion press 10. Those skilled in the art will appreciate that the axis of one or more of the various remaining critical components can be made to coincide with the longitudinal axis 50 of the extrusion press 10 if desired, using the remaining height data.

With the longitudinal axis 50 of the extrusion press 10 having been established, the transmitter mount 108 and the receiver mount(s) 110 are employed to characterize the lateral offset of the various critical components relative to the longitudinal axis 50 of the extrusion press 10. To aid in this step, gauging surfaces 200, which are illustrated in FIG. 7, are provided on each critical component by the machine tool manufacturer. Each gauging surface 200 is located on an associated critical component such that it is offset laterally by a predetermined distance from the longitudinal axis 50 of the extrusion press 10.

As illustrated in FIG. 7, the transmitter mount 108 permits the laser transmitter 102 to be mounted to one of the critical components (e.g., to the rear platen 42) so that a laser beam 102*a* that is generated is generally parallel to the longitudinal axis 50 and offset therefrom by a predetermined distance. Briefly, the transmitter mount 108 is a bracket that permits the laser transmitter 102 to be mounted to the gauging surface 200 that is formed on the rear platen 42.

One or both of the transmitter mount 108 and the laser transmitter 102 may be selectively positioned relative to the gauging surface 200 such that the laser beam 102*a* that is generated by the laser transmitter 102 is contained in a plane that is generally parallel to the longitudinal axis 50 of the extrusion press 10. Since each of the gauging surfaces 200 is machined flat and generally parallel to the longitudinal axis 50 of the extrusion press 10 and since the transmitter mount 108 positions the laser transmitter 102 such that the laser beam 102*a* is generated generally parallel to the gauging surface 200 on the rear platen 42, movement of the transmitter mount 108 and/or the laser transmitter 102 in the embodiment provided is limited to leveling the laser beam 102*a* such that it is contained in a generally horizontal plane.

With additional reference to FIG. 3, each receiver mount 110 is illustrated to include a mounting flange 210 and a spacing bar 212. The mounting flange 210 includes a generally flat abutting face 214 that is configured to abut the gauging surface 200 of a critical component (other than the rear platen 42). A slotted mounting aperture 216 is formed through the mounting flange 210 and sized to receive a conventional threaded fastener (not shown). The threaded fastener permits the mounting flange 210 to be fixedly but removably coupled to the gauging surface 200, while the slotted mounting aperture 216 provides the capability to raise or lower the mounting flange 210 on the gauging surface 200, as well as rotate the mounting flange 210. The spacing bar 212 is fixedly coupled to the mounting flange 210 and includes a mount 220. The mount 220, which is illustrated to include a pair of holes 222 for receiving an associated pair of dowels (not shown) that are removably attached to the digital laser receiver 104*a* in the example provided, provides a means by which the digital laser receiver 104*a* may be mounted to the spacing bar 212 at a predetermined distance away from the abutting face 214 of the mounting flange 210.

Preferably, the tooling set 100 includes two receiver mounts 110, one being associated solely with the front platen 40 and another to be used with the moving crosshead 24 and the container 30, so that if necessary, data can be collected while the extrusion press 10 is operating to thereby permit the technician to monitor the moving crosshead 24 or the container 30 shift during an extrusion cycle. Those skilled in the art will appreciate, however, that a single receiver mount 110 may be utilized for the collection of data from the front platen 40, the moving crosshead 24 and the container 30.

In operation, a receiver mount 110 is abutted to the gauging surface 200 on the front platen 40 and adjusted (vertically and rotationally) as necessary so that the laser beam 102*a* properly strikes the target portion 120 (i.e., the indicator 152 (FIG. 3) is illuminated with a green light in the example provided). We have found that a commercially available bubble level (not shown) may be employed to aid in and expedite the orienting of the receiver mount 110 (i.e., the bubble level permits the technician to rotate the receiver mount 110 such that the top surface of the spacing bar 212 is roughly parallel to the laser beam 102*a*). Since the spacing bar 212 positions the digital laser receiver 104*a* at a predetermined distance from the gauging surface 200 and the gauging surface 200 is offset from the longitudinal axis 50 by a known distance, the laser receiver 104 is employed to establish an offset axis 230.

With the offset axis 230 established, the other receiver mount 110 is employed in a manner that is similar to that described above to determine lateral offset values for the moving crosshead 24 and the container 30. More specifically, the receiver mount 110 is mounted to the gauging surface 200 of the moving crosshead 24, the digital laser receiver 104*a* is mounted thereto at a known position, and the spacing bar 212 is adjusted vertically and/or rotated as necessary so that the laser beam 102*a* properly strikes the target portion 120. The laser receiver 104 is employed to determine a lateral offset value for the moving crosshead 24 (i.e., a distance between the axis of the moving crosshead 24 and the longitudinal axis 50). Thereafter, the receiver mount 110 is removed from the moving crosshead 24 and mounted to the gauging surface 200 of the container 30. The digital laser receiver 104*a* is mounted to the receiver mount 110 at a known position and the spacing bar 212 is adjusted vertically and/or rotated as necessary so that the laser beam 102*a* properly strikes the target portion 120. The laser receiver 104 is employed to determine a lateral offset value for the container 30 (i.e., a distance between the axis of the container 30 and the longitudinal axis 50).

With the vertical and lateral offset values for the moving crosshead 24 known, we prefer to adjust the jack screws 72 on the moving crosshead 24 at this point in the process so that the stem 68 is approximately aligned (vertically and horizontally) to the longitudinal axis 50 of the extrusion press 10. While not mandatory, we prefer to align the stem 68 to the longitudinal axis 50 to minimize any side loading of the extrusion press 10 during an extrusion cycle.

Figure 9:
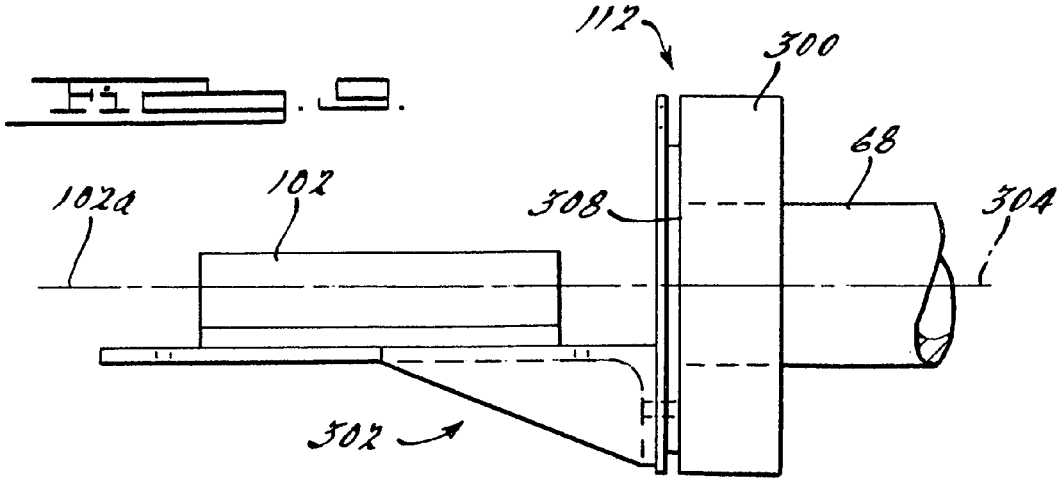
FIG. 9 is a side elevation view of a portion of the extrusion press of FIG. 1 illustrating the alignment of the laser transmitter to the axis of the stem.

In FIG. 8, the first and second chucks 112 and 114 are next employed to determine the position of the axis of the container 30 relative to the axis of the stem 68. With reference to FIG. 9, the first chuck 112 includes a centering device 300, such as a threejaw chuck, and a transmitter mount 302 that is coupled to the centering device 300. The centering device 300 permits the first chuck 112 to be removably coupled to the stem 68 in a manner which places the transmitter mount 302 in a known position relative to the axis of the stem 68. The laser transmitter 102 is coupled to the transmitter mount 302 so that when the first chuck 112 is mounted to the stem 68, the laser beam 102*a* is coincident to the axis 304 of the stem 68. The geometry of the stem 68 is such that its front face 308 is machined perpendicular to the axis 304 of the stem 68. Accordingly, the laser beam 102*a* is also generally perpendicular to the front face 308 of the stem 68.

Figure 10:
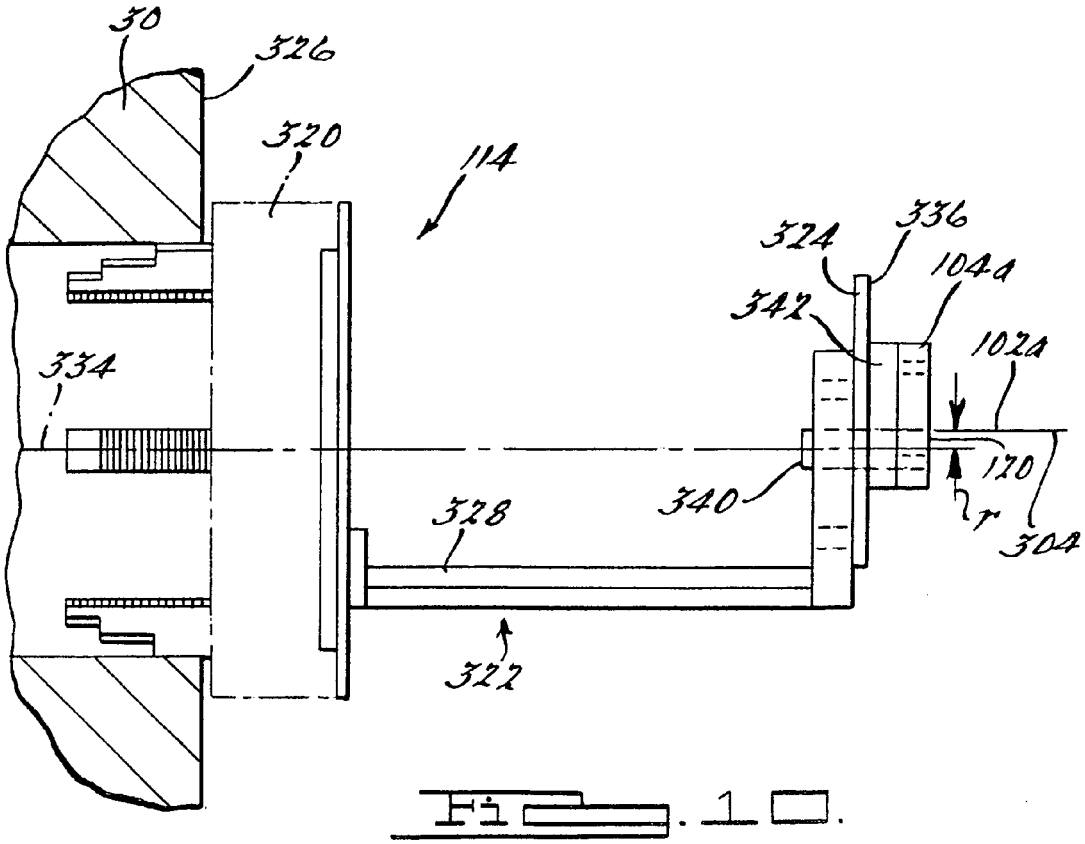
FIG. 10 is a side elevation view in partial section of a portion of the extrusion press of FIG. 1 illustrating the coupling of the laser receiver to a first side of the container and the alignment of the laser receiver to the axis of the container.

In FIG. 10, the second chuck 114 similarly includes a centering device 320, such as a three-jaw chuck, and a receiver mount 322. The centering device 320 permits the second chuck 114 to be removably coupled to the container 30 in a manner which places the receiver mount 322 in a known position relative to the axis of the container 30. The receiver mount 322 includes a mounting flange 324 to which the digital laser receiver 104*a* is rotatably mounted. The receiver mount 322 is configured such that the mounting flange 324 is spaced apart from the centering device 320 so as to protect the digital laser receiver 104*a* from the heat that is radiated from the container 30.

Figure 11:
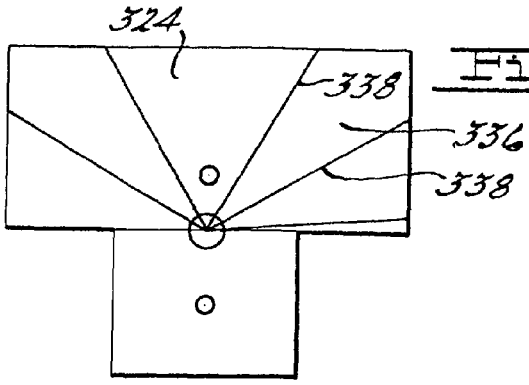
FIG. 11 is a front view of a portion of the receiver mount illustrating the mounting flange in greater detail.

In operation, the second chuck 114 is mounted to a front face 326 of the container 30 such that the mounting flange 324 is positioned in a known position. This could entail, for example, keying the second chuck 114 to or otherwise associating the second chuck 114 with the container 30, but we presently prefer to simply install the second chuck 114 so that a flat surface 328 on the receiver mount 322 is in a level condition. Placement of the mounting flange 324 in a known position is important in the example provided because the digital laser receiver 104*a* is only able to collect data along an axis that is transverse to the laser beam 102*a*. Accordingly, mounting the digital laser receiver 104*a* in a single, fixed position would not be appropriate, since the laser beam 102*a* would not necessarily strike the target portion 120. Stated another way, since the axes 302 and 334 of the stem 68 and the container 30, respectively, are movable relative to one another, there is no guarantee that their axes will be aligned in a predetermined manner. We have overcome this limitation by permitting the digital laser receiver 104*a* to rotate on the mounting flange 324 about the axis 334 of the container 30 and marking the face 336 of the mounting flange 324 with reference marks 338 (FIG. 11) at predetermined intervals, such as 30°, to indicate the angular orientation of the digital laser receiver 104*a*.

Figure 12A:
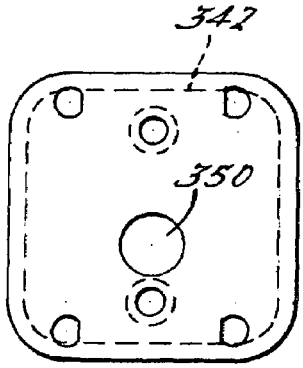
FIG. 12*a* is front view of a portion of the receiver mount illustrating the fixture block in greater detail.
Figure 12B:
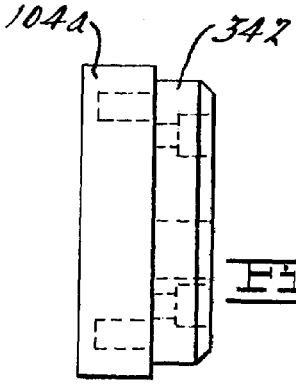
FIG. 12*b* is a side elevation view of the fixture block with the laser receiver coupled thereto.

More specifically, the receiver mount 322 includes a dowel pin 340 that is press fit into the mounting flange 324. The digital laser receiver 104*a* is removably coupled (via pins that are not specifically shown) to a fixture block 342. The fixture block 342 includes a hole 350 (FIGS. 12*a*, 12*b*) that is sized to receive the dowel pin 340 such that the fixture block 342 may rotate about the dowel pin 340. The dowel pin 340 is placed such that when the second chuck 114 is coupled to the container 30, the center of the dowel 340 is coincident with the axis 334 of the container 30.

In this way, the digital laser receiver 104*a* may be rotated into an angular orientation where the target portion 120 is struck by the laser beam 102*a*. The data from the laser receiver 104 provides a distance (r) between the laser beam 102*a* and the axis 334 of the container 30, while the reference marks 338 (FIG. 11) on the face 336 of the mounting flange 324 provide the angular orientation (θ) of the target portion 120. The data (r, θ) for this first point on the axis of the container 30 can readily be converted from its polar coordinate form into a conventional Cartesian coordinate form (X,Y) as follows: $X=r\times\sin(\theta)$; and $Y=r\times\cos(\theta)$.

Figure 13:
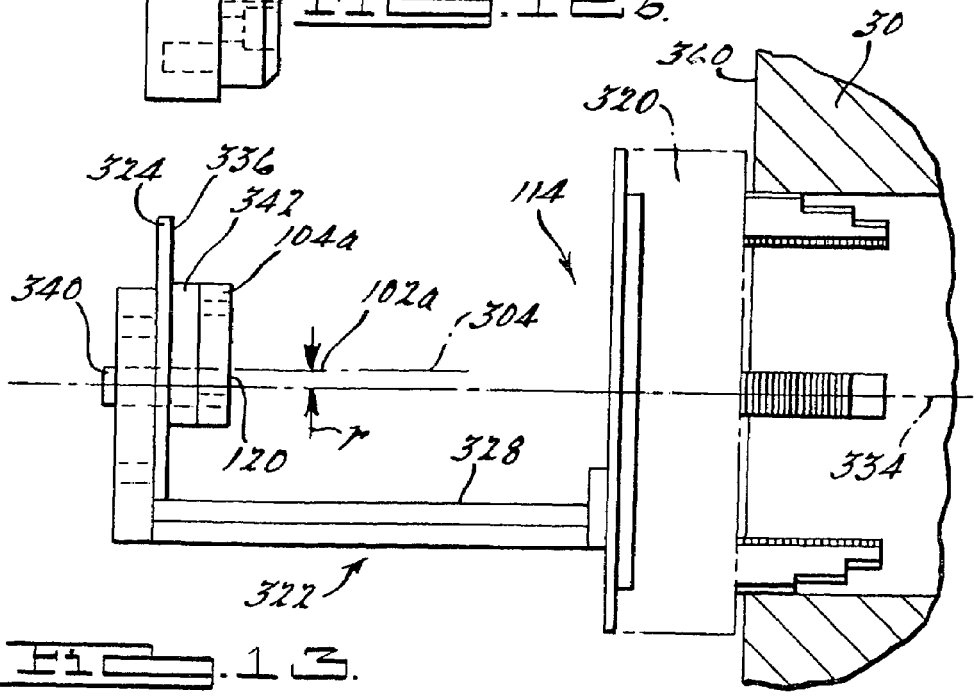
FIG. 13 is a view similar to that of FIG. 10 but illustrating the coupling of the laser receiver to a second side of the container and the alignment of the laser receiver to the axis of the container.

The second chuck 114 is removed from the front face 326 of the container, the position of the mounting flange 324 is reversed and the second chuck 114 is installed to the rear face 360 of the container 30 as shown in FIG. 13. The above-described process is repeated to identify a second point on the axis 334 of the container 30 to thereby permit the technician to determine the position of the axis 334 of the container 30 relative to the axis 304 of the stem 68.

Figure 14:
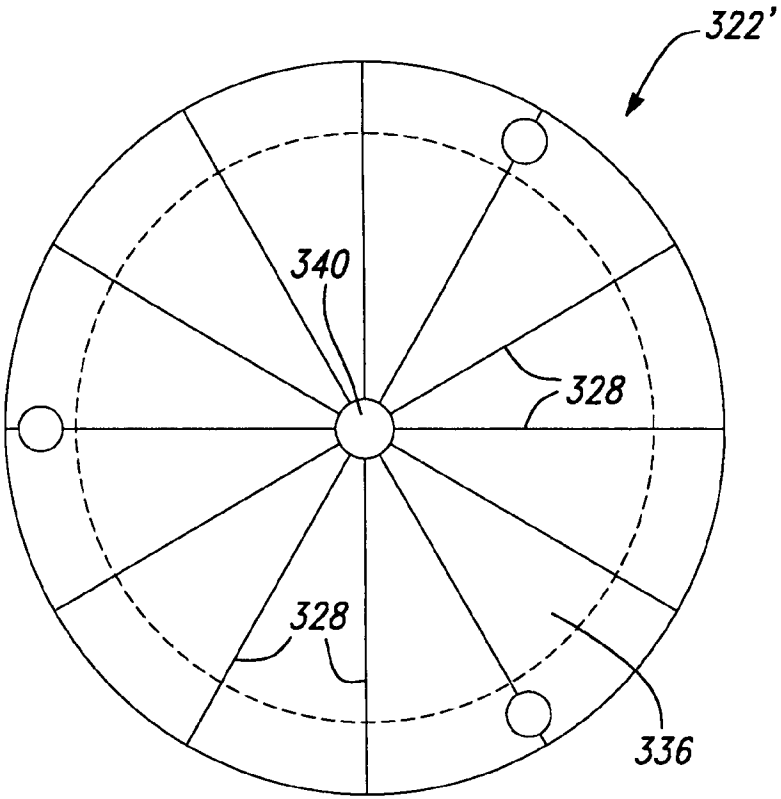
FIG. 14 is a front view of an alternately constructed receiver mount.
Figure 15:
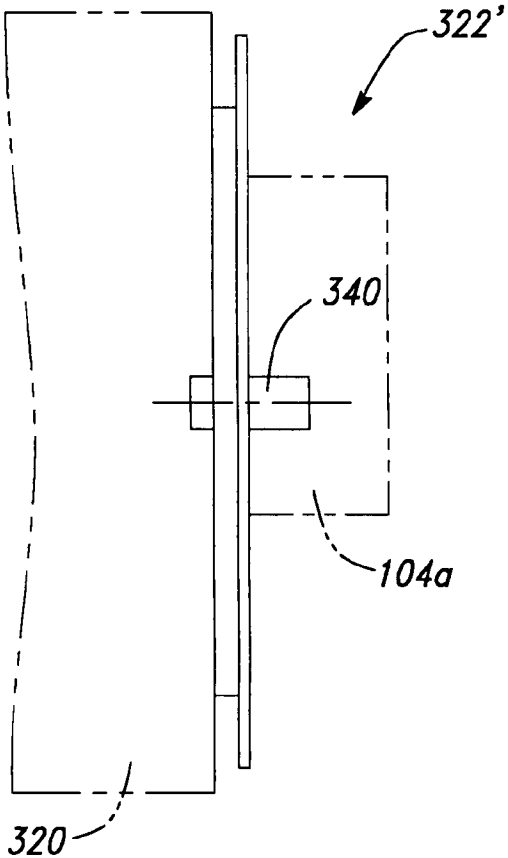
FIG. 15 is a side elevation view of the receiver mount of FIG. 14 in operative association with a centering device and a digital laser receiver.

Although the methodology of the present invention has been described as employing a single second chuck 114 to collect data on the opposite faces of the container 30, those skilled in the art will appreciate that various modifications may be made to the tooling without departing from the scope and spirit of the invention described herein. In this regard, the tooling set 100 may include a second receiver mount 322' that may be coupled directly to the centering device 320 as illustrated in FIGS. 14 and 15. In this example, the receiver mount 322' is removably coupled to the centering device 320 in a precise manner (e.g., via flat head cap screws or shoulder bolts) such that the digital laser receiver 104*a* may be rotated relative to the centering device 320 as described above.

Using the data from the measurement step, the technician is able to determine whether any of the corresponding critical devices (CCD) have been positioned in a strategic position ($SP_{CD}$) that adversely effects the output of the machine tool. If so, the technician adjusts the corresponding critical devices (CCD) as necessary so that no critical device (CD) is positioned in a strategic position ($SP_{CD}$) that adversely effects the output of the machine tool.

With regard to the example provided, the data from the measurement step permits the technician to identify those situations where the axes 304 and 334 are not coincident, as well as to formulate a response or action which, when implemented, will render the axes 304 and 334 generally coincident. Generally speaking, once the relative positions of the axes (304, 334) of the stem 68 and the container 30 are known, it is within the capabilities of one of ordinary skill in the art to identify which of the jack screws 72*a* and 72*b* must be adjusted and the amount by which each of these jack screws 72*a* and 72*b* are to be adjusted. Those skilled in the art will also appreciate that a computerized program or spreadsheet may be employed to record the data taken during the measurement step, as well as to automatically identify the jack screws 72*a* and 72*b* that are to be adjusted and an amount by which they are to be adjusted.

The experimentation step essentially requires that the technician test the results of the process after an adjustment has been made. In the example provided, we tested our results by measuring the concentricity of the tubes that were produced by the extrusion press 10. Our process permitted significant reductions in the eccentricity of the tubes produced by the extrusion press 10, as well as reduced the occurrence of eccentricity-based breakage during the extrusion of tubes.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A method for calibrating a machine tool, the machine tool producing an output, the method comprising:

identifying a plurality of critical components (CC);

identifying each critical device (CD) that is employed to affect a position of an associated critical component (CC);

identifying a plurality of possible positions ($PP_{CD}$) for each critical device (CD);

identifying a plurality of possible combinations (PC), each possible combination (PC) including one of the possible positions ($PP_{CD}$) for each of the critical devices (CD);

evaluating each of the possible combinations (PC) to identify which of said possible combinations ($PC_A$) adversely affect the output of the machine tool; and adjusting the corresponding critical devices (CD) as necessary so that no critical device (CD) is positioned in a strategic position that would adversely affect the output of the machine tool.

2. The method of claim 1, wherein each of the possible combinations (PC) is identified in a Yates algorithm.

3. The method of claim 1, wherein the evaluating step includes modeling at least one of the possible combinations (PC) to determine an effect of the possible combination (PC) on the output of the machine tool.

4. The method of claim 3, wherein computerized three-dimensional solids modeling is employed in the modeling step.

5. The method of claim 1, further comprising:

identifying a plurality of strategic positions ($SP_{CD}$) from said possible combinations ($PC_A$) that adversely effect the output of the machine tool, each strategic position ($SP_{CD}$) being associated with a corresponding critical device (CCD);

determining an actual position of each critical component (CC);

determining whether any of the corresponding critical devices (CCD) have been positioned in a strategic position ($SP_{CD}$) that adversely effects the output of the machine tool and if so, making an adjustment to at least one of the critical devices (CD) so that no critical device (CD) is positioned in a strategic position ($SP_{CD}$) that adversely effects the output of the machine tool.

6. The method of claim 5, wherein the at least one of the critical devices (CD) is adjusted to align at least one of the critical components (CC) to a predetermined datum.

7. The method of claim 6, wherein the predetermined datum is derived from a selected one of the plurality of strategic components (SC).

8. The method of claim 7, wherein the predetermined datum is a longitudinal axis of the selected one of the plurality of critical components (CC).

9. The method of claim 5, wherein the critical devices (CD) are jack screws and the method further comprises determining an amount and direction by which each jack screw is to be rotated.

10. The method of claim 1, wherein at least a portion of the possible positions ($PP_{CD}$) are relative positions.

11. A method for calibrating an extrusion press, the extrusion press having a main ram, a moving crosshead and a container, the main ram including a front platen and a rear platen, the moving crosshead including a stem, the method comprising:

establishing an axis of the stem while the stem is axially spaced apart from the container;

establishing an axis of the container; and directly aligning the one of the container and the stem directly to the axis of the other one of the container and the stem by adjusting one of the container and the stem such that the axis of the one of the container and the stem is coincident to the axis of the other one of the container and the stem;

wherein a laser transmitter is employed to establish the axis of the stem.

12. The method of claim 11, wherein a chuck is employed to removably couple the laser transmitter to the stem.

13. The method of claim 11, wherein a chuck and a laser receiver are employed to establish the axis of the container.

14. The method of claim 13, wherein the step of establishing the axis of the container comprises:

determining a location of a first point on the axis of the container; and determining a location of a second point on the axis of the container.

15. A method for calibrating an extrusion press, the extrusion press having a main ram, a moving crosshead and a container, the main ram including a front platen and a rear platen, the moving crosshead including a stem, the method comprising:

establishing an axis of the stem while the stem is axially spaced apart from the container;

establishing an axis of the container; and directly aligning the one of the container and the stem directly to the axis of the other one of the container and the stem by adjusting one of the container and the stem such that the axis of the one of the container and the stem is coincident to the axis of the other one of the container and the stem;

wherein a plurality of jack screws are employed to selectively position the container and wherein the step of adjusting the container includes determining an amount and direction in which each of the jack screws is to be rotated.

16. A method for calibrating an extrusion press, the extrusion press having a main ram, a moving crosshead and a container, the main ram including a front platen and a rear platen, the moving crosshead including a stem, the method comprising:

aligning one of the container and the stem directly to an axis of the other one of the container and the stem; and aligning the moving crosshead horizontally and vertically to an axis defined by the main ram, wherein the step of aligning the moving crosshead horizontally comprises:

mounting a laser transmitter to one of the front and rear platens;

moving a laser receiver to the other one of the front and rear platens;

generating a laser beam with the laser transmitter;

receiving the laser beam with the laser receiver to establish an offset axis, the offset axis being horizontally offset from the axis of the main ram by a predetermined distance;

mounting the laser receiver to the moving crosshead;

receiving the laser beam with the laser receiver to determine an amount by which an axis of the moving crosshead is horizontally offset from the offset axis; and calculating an amount by which the axis of the moving crosshead is horizontally offset from the axis of the main ram.

17. A method for calibrating an extrusion press, the extrusion press having a main ram, a moving crosshead and a container, the main ram including a front platen and a rear platen, the moving crosshead including a stem, the method comprising:

aligning one of the container and the stem directly to an axis of the other one of the container and the stem; and aligning the moving crosshead horizontally and vertically to an axis defined by the main ram, wherein the step of aligning the moving crosshead vertically comprises:

mounting a laser transmitter on a first lateral side of the extrusion press, the laser transmitter generating a laser beam that is contained in a first horizontal plane;

mounting a laser receiver to the rear platen on the first lateral side;

transmitting the laser beam in the first horizontal plane to the laser receiver to determine a first elevation of the rear platen;

mounting the laser receiver to the front platen on the first lateral side;

transmitting the laser beam in the first horizontal plane to the laser receiver to determine a first elevation of the front platen;

mounting the laser receiver to the moving crosshead on the first lateral side;

transmitting the laser beam in the first horizontal plane to the laser receiver to determine a first elevation of the moving crosshead;

mounting the laser receiver to the container;

transmitting the laser beam in the first horizontal plane to the laser receiver to determine an elevation of the container;

mounting a laser transmitter on a second lateral side of the extrusion press such that the laser transmitter generates the laser beam in a second horizontal plane;

transmitting the laser beam in the second horizontal plane to the laser receiver that is mounted on the container to determine a lateral elevation offset;

mounting the laser receiver to the rear platen on the second lateral side;

transmitting the laser beam in the second horizontal plane to the laser receiver to determine a second elevation of the rear platen;

mounting the laser receiver to the front platen on the second lateral side;

transmitting the laser beam in the second horizontal plane to the laser receiver to determine a second elevation of the front platen;

mounting the laser receiver to the moving crosshead on the second lateral side;

transmitting the laser beam in the second horizontal plane to the laser receiver to determine a second elevation of the moving crosshead;

employing the first and second elevations of the rear platen, the first and second elevations of the front platen and the lateral elevation offset to determine a position of the axis of the main ram in a generally vertical plane; and employing the first and second elevations of the moving crosshead and the lateral elevation offset to determine a position of the axis of the moving crosshead in the generally vertical plane.

18. The method of claim 17, further comprising adjusting the moving crosshead such that the axis of the moving crosshead and the axis of the main ram are coincident in the generally vertical plane.

19. The method of claim 18, wherein a plurality of jack screws are employed to selectively position the moving crosshead and wherein the step of adjusting the moving crosshead includes determining an amount and direction in which each of the jack screws is to be rotated.

* * * * *